United States Patent [19]

Munroe et al.

[11] Patent Number: 5,012,495

[45] Date of Patent: Apr. 30, 1991

[54] SWITCH AND CIRCUIT BREAKER COMBINATION DEVICE

[75] Inventors: Ronald G. Munroe, Hallandale, Fla.; Christopher J. Sedlmayr, New York, N.Y.

[73] Assignee: Eagle Electric Mfg. Co. Inc., Long Island City, N.Y.

[21] Appl. No.: 495,495

[22] Filed: Mar. 19, 1990

[51] Int. Cl.[5] ..... H01H 37/00; H01H 71/16

[52] U.S. Cl. ..... 337/3; 337/13; 337/66; 337/72; 200/242; 200/535

[58] Field of Search ..... 337/2, 1, 3, 12, 13, 337/66, 72, 35; 200/241, 242, 535

[56] References Cited

U.S. PATENT DOCUMENTS

| | | | |
|---|---|---|---|
| 2,717,297 | 9/1955 | Walker | 200/242 |
| 4,035,596 | 7/1977 | Marquardt et al. | 200/535 |
| 4,480,937 | 11/1984 | Eckhardt | 200/535 |
| 4,528,538 | 7/1985 | Andersen | 337/2 |
| 4,894,499 | 1/1990 | Beck et al. | 200/241 |

*Primary Examiner*—Harold Broome

*Attorney, Agent, or Firm*—Kirschstein, Ottinger, Israel & Schiffmiller

[57] ABSTRACT

An improved device for protecting an electrical load from a current overload combines an electrical switch and a re-settable circuit breaker in a single housing. The device avoids the use of gate plates, visually alerts an operator to the existence of a tripped conditions, and provides automatically self-aligning, evenly-wearing contacts for the switch.

15 Claims, 3 Drawing Sheets

FIG. 1
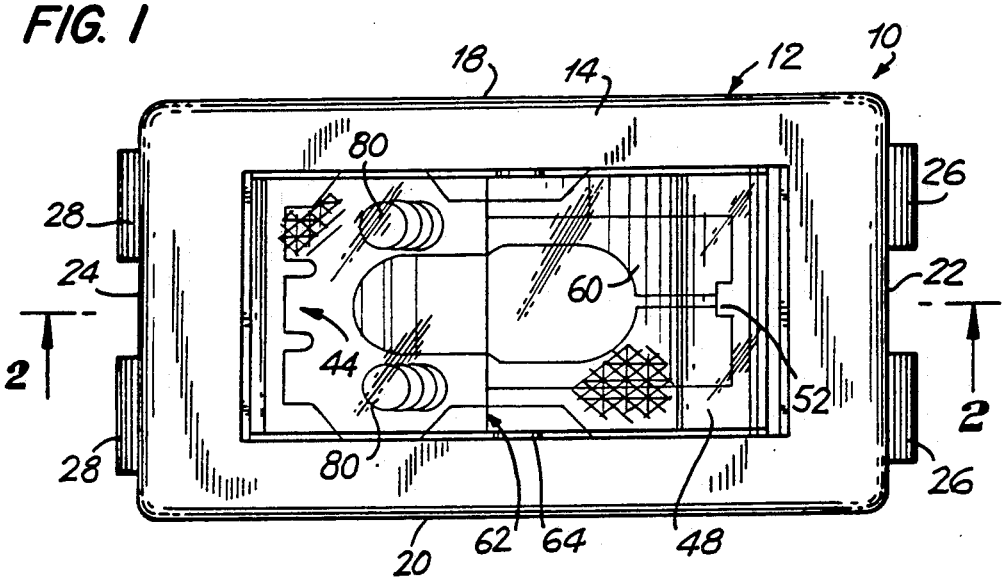
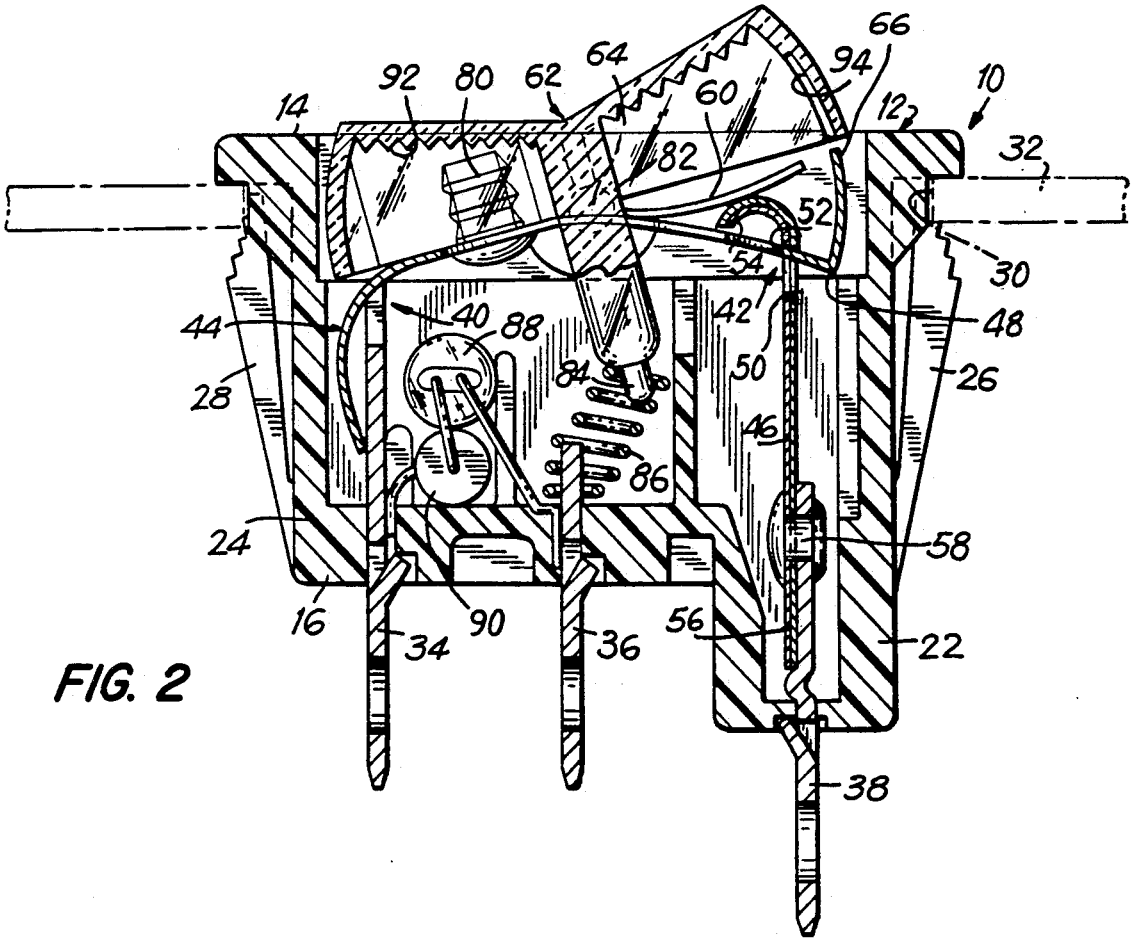
FIG. 2

SWITCH AND CIRCUIT BREAKER COMBINATION DEVICE

BACKGROUND OF THE INVENTION

1. Field of the Invention

This invention generally relates to electrical switches and electrical circuit breakers and, more particularly, to a combination device that is more convenient to operate and inexpensive to manufacture and to assemble.

2. Description of Related Art

It is well known to use a circuit breaker to protect one or more sensitive electrical components in electrical circuits from large currents such as may be caused by component malfunctions or external power surges. The circuit breaker, also known as a fuse, is connected between a power source and the components, or load, to be protected. The breaker contains an element, typically a bimetal, that "trips" when excessive current flows through it. The tripped element opens the circuit and disconnects the power source from the components, thereby preventing damage to the components.

Electrical equipment containing a circuit breaker commonly includes an on/off power switch electrically connected in series with the breaker for activation/-deactivation of the equipment by a user. When the breaker trips due to a current overload, the user is supposed to perform the following three steps in sequence: first, turn the power switch off to its open position; second, reset the breaker; and then third, turn the power switch on to its closed position. If the overload current is still present, the breaker will trip again after the power switch is closed. If the overload current is no longer present, the equipment has been rendered operational again.

The art has proposed, in U.S. Pat. No. 4,528,538, to combine the power switch and the circuit breaker in a single device, and to render the combined device more convenient to operate after the breaker has been tripped by reducing the aforementioned three steps to two. Thus, the patented device provides an arrangement wherein opening the switch,after the breaker has been tripped, simultaneously resets the tripped breaker. Thereupon, closing the switch returns the device to normal operation.

Although generally satisfactory for its intended purpose, the device disclosed in the aforementioned patent has proven to be not altogether reliable in operation, complex in construction and relatively expensive to manufacture and assemble. The patented device has multiple parts and springs, all requiring precise placement. The patented device, in common with other circuit breakers, utilizes a synthetic plastic material gate plate which slides between and rubs against the breaker contacts. The plastic gate plate is thus exposed to electrical arcing at the breaker contacts. This arcing causes the plastic material of the gate plate to vaporize over time, and eventually the vaporized plastic coats the breaker contacts, as well as other exposed conductive surfaces within the device. The plastic coating is very disadvantageous and may interfere with the intended operation of the device. Electrical deterioration, including loss of accuracy of the bimetallic tripping element, are therefore inevitable consequences of such gate plate-type devices.

In addition, the patented device employs, for high amperage applications, silver contacts at the switch. However, the use of silver contacts is very expensive.

Also, the tripping of the circuit breaker is not readily apparent to a user, particularly one located at a distance from the device. In addition, safety regulatory agencies require a circuit breaker to be "trip-free", i.e. the breaker must trip to the "off" position, even if a manually-operated switch/breaker actuator is deliberately held in an "on" position.

SUMMARY OF THE INVENTION

1. Objects of the Invention

It is a general object of this invention to advance the state of the art of combined switch and circuit breaker devices.

It is another object of this invention to inprove the reliability and performance of such devices.

Another object of this invention is to eliminate the use of gate plates in such devices and prevent the formation of undesirable plastic coatings over exposed conductive surfaces of such devices.

A further object of this invention is to eliminate the use of silver contacts, even for high amperage applications.

Still another object of this invention is to visually and readily indicate to a user the existence of a tripped condition for such devices.

Yet another object of this invention is to provide self-aligning, evenly-wearing contacts for the switch of such devices.

Another object of this invention is to provide a safe "trip-free" device.

A still further object of this invention is to form such devices with a minimum number of parts.

Yet a further object of this invention is to render such devices inexpensive and quicker to manufacture and to assemble.

Still another object of this invention is to increase the working lifetime and durability of such devices.

2. Features of the Invention

In keeping with these objects, and others which will become apparent hereinafter, one feature of this invention resides, briefly stated, in an improved switch and circuit breaker combination device for protecting an electrical load from electrical current overload. The device comprises a housing, electrical switching means thereon, resettable circuit breaker means thereon, and an actuator means. The switching means includes an actuatable switch element movable between open and closed positions to respectively prevent and enable electrical current to flow through the switching means. The circuit breaker means is operative for interrupting current flow to the load in response to a current overload, and for preventing resumption of the current flow until the breaker means is reset.

The breaker means is electrically connected in series with the switching means, and includes a latch element and a resettable trip element. The latch element is movable along a path in response to the current overload from a latched position to a tripped position in which the latch and trip elements are respectively latched and unlatched relative to each other.

The actuator means resets the trip element from the tripped to the latched position, and simultaneously moves the switch element from the closed to the open position to prevent current from flowing to the load during resetting. The actuator means is also operative for moving the switch element from the open to the closed position, while maintaining the trip element in the latched position to enable current to resume flowing to the load after resetting.

The actuator means includes an actuator mounted on the housing for manual displacement. The switch element is mounted on the actuator for joint displacement therewith. The trip element is mounted on the actuator for joint displacement therewith during resetting. The trip element is biasingly urged for displacement relative to the actuator away from said path to the tripped position, and maintained at a distance from, and out of engagement with, the latch element until the breaker means is reset.

By urging the trip element away from said path and maintaining the trip element at a distance from, and disengaged with, the latch element, the use of gate plates according to the prior art is eliminated, thereby also preventing the concomitant problems of forming undesirable plastic coatings over exposed conductive surfaces of such devices. Moreover, the number of parts in such devices is kept to a minimum, thereby rendering such devices less expensive to manufacture and assemble.

Another feature of this invention resides in the provision of self-aligning, evenly-wearing contacts for the switching means of such devices. Preferably, the movable switch element includes a plurality of movable contacts in wiping contact with a stationary contact of the switching means in the closed position. In a preferred case, three movable contacts having curved shapes terminate in linear edge regions that are mutually co-linear. The multiple linear edge regions are self-aligning due to the automatic even wear of the points of initial contact with the stationary contact. Also, for high amperage applications, rather than constituting the movable switch element contact of silver, the movable contacts of this invention are constituted of a copper alloy which is much less expensive.

Still another feature of this invention resides in visually and readily indicating to a user the existence of a power-on or a tripped condition for such devices. To that end, indicator means are provided for visually indicating the occurrence of the power-on or tripped condition. Preferably, the indicator means includes a lamp, preferably a neon lamp, within the housing that is lit only upon the occurrence of the tripped condition, and/or a flag mounted on the trip element and visible through the actuator only upon the occurrence of the tripped condition. To facilitate such visibility, the actuator is provided with a transparent window.

Still another feature of this invention resides in maintaining the calibration of such devices. Typically, the latch element is a thermally-sensitive, bimetallic element that bends when electrical current passes therethrough which exceeds a predetermined threshold. The bimetallic element is formed with an opening through which a trip finger or tongue of the trip element is receivable with a latch-type action. The device of this invention is specifically designed so that the contact regions between the trip element and the latch element never directly experience an electrical arc, thereby maintaining the calibration of the bimetallic element.

To that end, the circuit breaker means includes a pair of breaker contacts through which current flows through the breaker means. The breaker contacts are spaced from the contact regions engaged by the latch and trip elements. The breaker contacts engage before the contact regions engage during movement of the breaker means from the tripped to the latched position. By causing the contact regions to engage later, they never experience the inevitable electrical arcing caused when the device is reset. Also, during resetting, the switch element must first be moved to the open position before the latch and trip elements come into contact. No arc can be present, because the switching means and the breaker means arc in series. It is during an overload that would cause the contact regions of the latch and trip elements to disengage first, before the breaker contacts which generate the arc. Hence, the bimetallic element maintains its calibration, and the reliability and performance of such devices is improved over the known devices.

The switch element and the trip element are preferably constituted of a one-piece construction from a copper alloy plate. The one-piece plate, also known as a bridge, is fastened directly to the actuator for ease of assembly and for greater holding security.

It will be seen that the device of this invention reduces the three distinct steps listed above into two actions, since the opening of the switching means and the resetting of the circuit breaker means occur simultaneously simply by moving the actuator to a reset position. Thereupon, by again moving the actuator in a distinct second step, the switching means is closed.

Since the switching means and the circuit breaker means are conveniently packaged within a single compact housing, the device can be conveniently mounted in a panel cutout with a snap-type action by using integral snap-action legs integrally formed on the housing.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a top plan view of a device according to this invention;

FIG. 2 is a sectional view taken on line 2—2 of FIG. 1 of the device in a normally operational condition of use;

DETAILED DESCRIPTION OF THE PREFERRED EMBODIMENT

Figure 3:
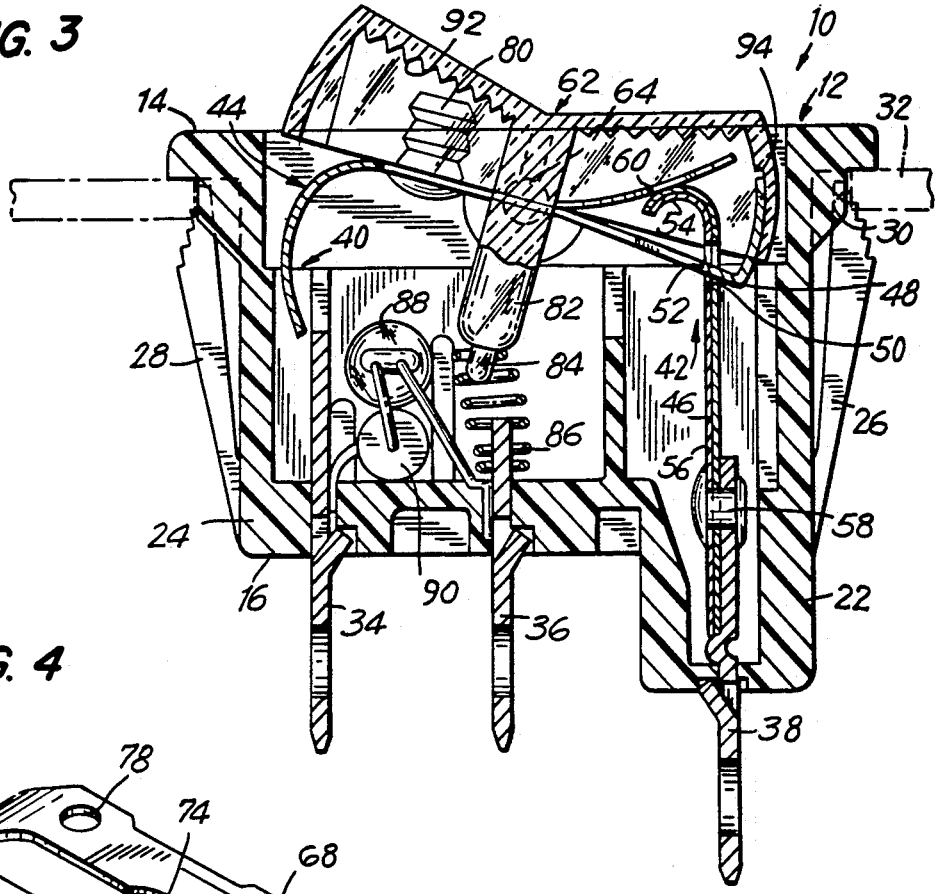
FIG. 3 is a view similar to FIG. 2, but showing the device in a reset condition.

Referring first to FIGS. 1 and 2 of the drawings, reference numeral 10 generally identifies a device according to a preferred embodiment for protecting an electrical load from an electrical current overload. The device 10 includes an insulating housing 12 of a generally parallelepiped shape, and having a top wall 14, a base wall 16 spaced from the top wall, a pair of opposite mutually parallel side walls 18, 20, and a pair of opposite mutually parallel end walls 22, 24, all of the walls bounding an interior. Opposite pairs 26, 28 of resilient legs are provided at the opposite end walls for securely mounting the housing with a snap-type action in a generally rectangular cutout 30 of a panel 32. One end of each leg is integrally formed with an end wall. The opposite end of each leg has a toothed formation for grippingly engaging the panel cutout 30.

Load terminal 34, ground neutral terminal 36 and hot terminal 38, each of blade-like construction, are anchored to the base wall 16, and extend from the interior of the housing to the exterior thereof for connection to a non-illustrated power source and non-illustrated electrical components, i.e. the load to be protected from an overload condition.

Figure 4:
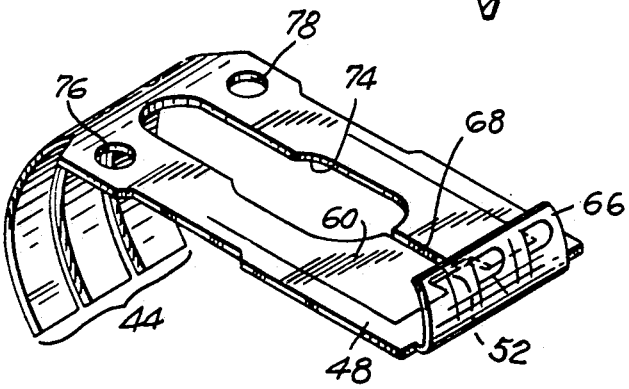
FIG. 4 is a front perspective view of a bridge component of the device according to this invention.
Figure 5:
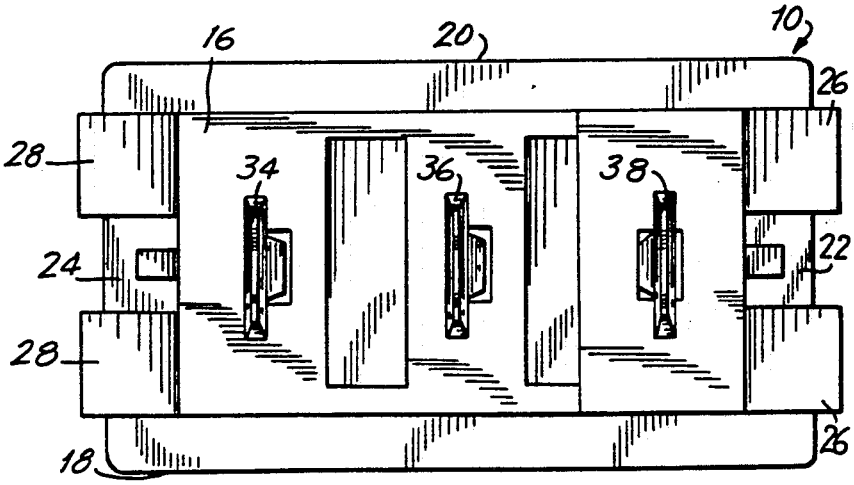
FIG. 5 is a bottom plan view of the device of FIG. 1.

The device 10 includes an electrical power switch and a circuit breaker, generally identified by reference numerals 40, 42, respectively. The switch 40 and the breaker 42 are electrically connected in series with each other. The switch 40 includes a movable switch element 44, preferably formed as a trio of curved arms (see FIG. 4), each having a generally C-shaped cross-section. The arms 44 are electrically connected in parallel with one another, and terminate in a trio of linear edge regions that ideally are co-linear with one another. The linear edge regions together serve as a set of movable contacts that simultaneously, wipingly, electromechanically engage load terminal 34 to define a closed switch position, the load terminal 34 serving as a stationary contact for the switch. When the arms 44 are spaced away from load terminal 34, the switch is in an open position. The arms 44 are self-aligning and wear evenly as described below.

The circuit breaker 42 includes a latch element 46, preferably a thermally-sensitive bimetallic element, and a re-settable trip element 48. The bimetallic element 46 is preferably formed with an opening 50 in which a trip finger or tongue 52 of the trip element 48 is receivable with a latch-type action. When the tongue 52 latchingly engages the opening 50, the circuit breaker is defined as being in a latched position. When the tongue 52 is unlatched or released from the opening 50, the circuit breaker is defined as being in a tripped position.

The bimetallic element 46 moves in response to a current overload from the latched to the tripped position. Electrical current flows through the bimetallic element in the latched position to generate heat. When the current exceeds a predetermined threshold, for which the bimetallic element is calibrated in advance, the heat that is generated will cause the bimetallic element to bend, disengage the latch, and snap into the tripped position.

The bimetallic element 46 has a generally inverted J-shaped contact end 54, and an opposite end 56 that is anchored to the hot terminal 38 by means of a rivet 58 or analogous fastener. The contact end 54 serves as one breaker contact, and another breaker contact 60 engages the breaker contact 54 only during re-setting of the circuit breaker as described below.

An actuator 62 is mounted on the housing for manually-actuated reciprocal rocking movement about a pivot pin or axis 64. The aforementioned arms 44, the trip element 48 and the breaker contact 60 are preferably formed of a one-piece construction from a copper alloy plate which is stamped and formed into the shape illustrated in FIG. 4. An indicator flag 66, whose purpose is described below, is also integrally formed with the one-piece plate. The breaker contact 60 is preferably divided into two parts by the formation of a central slit 68 therebetween. A generally U-shaped slit 70 divides both parts of the breaker contact 60 from the trip element 48. The one-piece plate, also known as a bridge, is formed with a keyhole-shape aperture 74 at a central region thereof. A pair of mounting holes 76, 78 are formed at opposite sides of the aperture 74. A pair of fasteners 80 extend through the mounting holes 76, 78, and securely mount the bridge to the underside of the actuator 62.

The actuator 62 has two manually-engageable touch surfaces mutually inclined at a fixed obtuse angle. A cylindrical stem 82 terminating in a projection 84 extends through the pivot axis 64 from the underside of the actuator 62 into the housing 12. An over-the-center coil spring 86 has one end surrounding and engaging the projection 84, and an opposite end surrounding and engaging an inner part of the ground terminal 36. The terminal 36 and the spring 86 generally lie in a plane that is offset from the pivot axis 64. The actuator 62 has two positions, and the offset spring 86 affirmatively urges and maintains the actuator in either one of the two positions selected by the user.

A neon lamp 88 and a voltage dropping resistor 90 are electrically connected in series between the load 34 and ground 36 terminals. The lamp 88 is lit only when the circuit breaker is in the tripped position The actuator is formed of a light-transmissive,synthetic, plastic material, and is preferably formed at its underside with a light-scattering,roughened surface 92 for scattering the light emitted by the lamp 88.

The flag 66 preferably bears the word "TRIP", or a word of like import,to signify the existence of a tripped position. The flag 66 in the tripped position is situated in a recessed transparent window 94 formed in the actuator 62, thereby visually alerting the user to the existence of a tripped position. The flag 66 and the lamp 88, therefore, serve as visual indicators.

In a less expensive embodiment, the neon lamp 88, the resistor 90 and the ground terminal 36 can be eliminated. The neon lamp 88 could be will so that it indicates a tripped condition by lighting "on", by wiring it between the hot 38 and load 34 terminals. With this arrangement, the ground or neutral terminal 36 would not be present, or needed.

The operation of the device will now be described: FIG. 2 shows the device in its normal operating condition, with the switch 40 and the circuit breaker 42 both closed and conducting electrical current. The switch 40 is closed due to the mutual contact between the linear edge regions of the arms 44 and the hot terminal 34. The circuit breaker 42 is closed due to the mutual contact between the bimetallic latch element 46 and the trip element 48 at the contact regions where the tongue 52 engages the opening 50. Electrical current from the power source flows successively through the hot terminal 38, the bimetallic latch element 46, the trip element 48, the arms 44, the load terminal 34 and, thereupon, to the load to be protected. The spring 86 affirmatively maintains the actuator 62 in its position shown in FIG. 2. In the normal operating condition of FIG. 2, the bimetallic latch element 46 is latched to the trip element 48 due to the latching action between the tongue 52 and the opening 50. The flag 66 is not located in the recessed window 94. The lamp 88 is lit. The light-scattering surface 92 of the actuator magnifies the visual warning signal emitted by the lamp.

Figure 6:
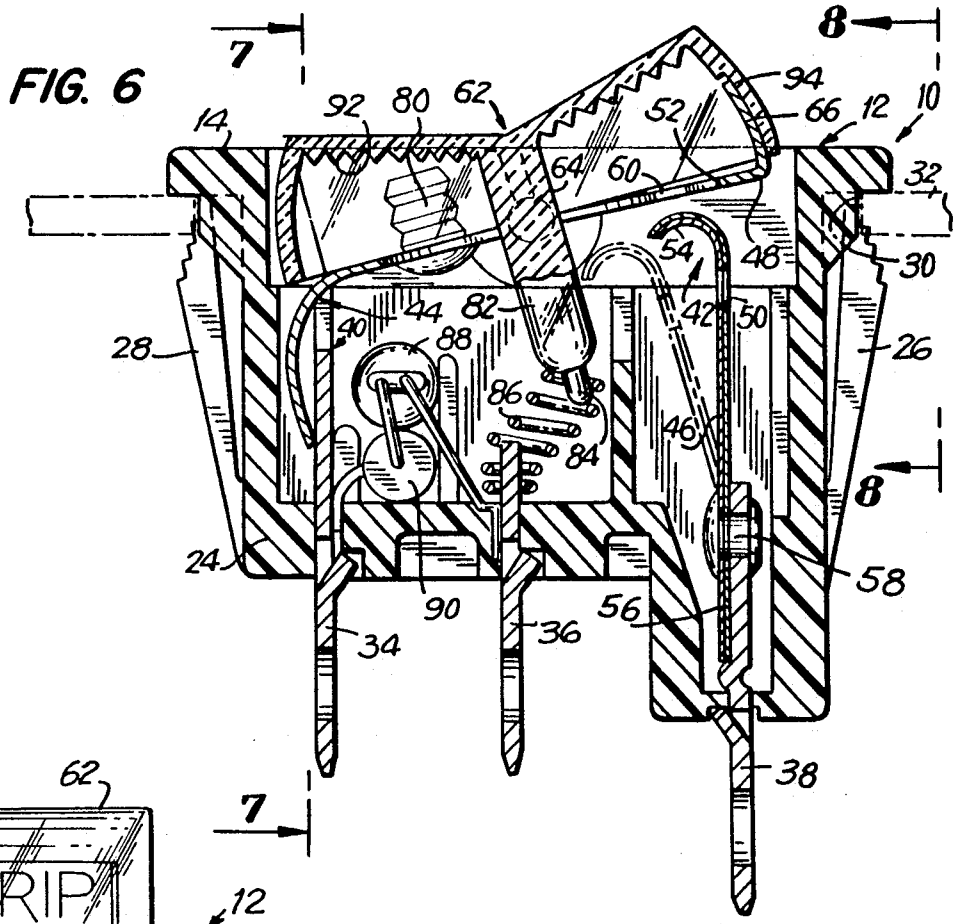
FIG. 6 is a view analogous to FIG. 2, but showing the device in a tripped condition of use.
Figure 8:
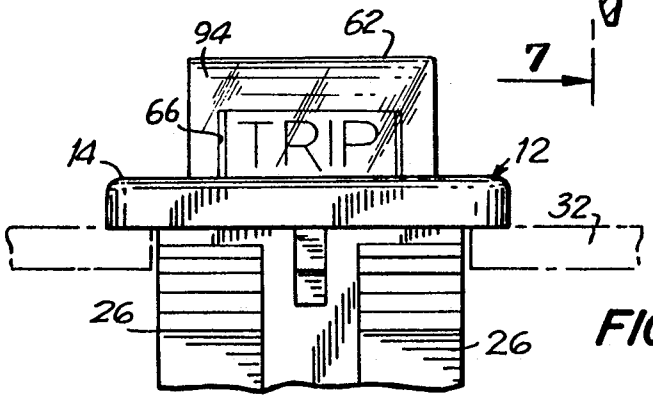
FIG. 8 is a view taken on line 8—8 of FIG. 6.
Figure 7:
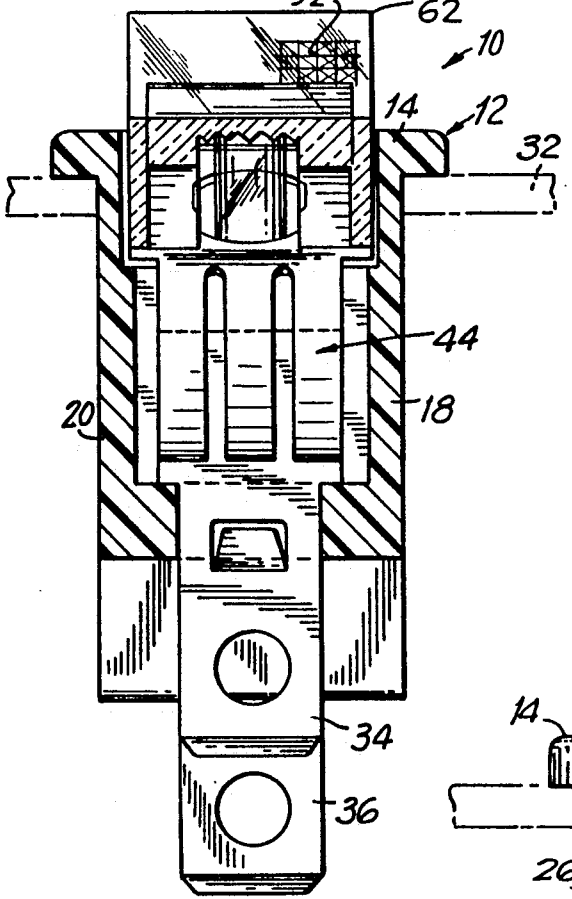
FIG. 7 is a sectional view taken on line 7—7 of FIG. 6.

When a current overload condition causes the bimetallic latch element 46 to move along travel path toward the phantom-line position shown in FIG. 6, the opening 50 is moved away from the tongue 52, thereby unlatching the trip element 48. The trip element 48, as are all the other component parts of the bridge, is formed of a resilient material. In the latched position, the trip element 48 is held under tension out of its relaxed state by the bimetallic latch element 46. Due to its inherent resilience, the unlatched trip element 48 urges itself away from the travel path of the bimetallic latch element 46 to a tripped position which is remote from the travel path. The trip element 48 urges itself along a circumferential path whose center of curvature lies to the left of the pivot axis 64, and maintains itself at a non-negligible distance from, and out of engagement with, the bimetallic latch element 46 which, itself, moves in a circumferential direction along the travel path whose center of curvature lies at the rivet 58. The trip element 48 moves relative to the actuator 62, and stops against its lower edges. The flag 66 comes to rest in the recessed window 94 of the actuator. During its upward travel, the trip element 48 carries with it the breaker contact 60 which disengages and separates from the top of the bimetallic element 46 at contact end 54, thus interrupting the current flow. The generated arc occurs at the contact end 54, rather than at the latched contact regions 50,52. The flag 66 visually alerts the user that a tripped condition has occurred. The lamp 88 is unlit at this time, thereby also serving to alert the user of the occurrence of the tripped condition.

Although the switch 40 remains closed during the tripped condition of the device, current cannot flow to the load since the circuit breaker is open, and current flow to the load has therefore been interrupted because there is no longer any engagement between the contact regions of the tongue 52 and opening 50; nor between the breaker contacts 60 and 54. With the interruption of current flow through the circuit breaker 42, the bimetallic latch element 46 eventually cools and returns in a counter-current circumferential direction along the travel path to its original upright position within the housing in which the bimetallic element extends generally perpendicularly of the base wall 16. During the return of the bimetallic element, the trip element 48 maintains itself well away from the travel path of the bimetallic element. There is no longer any need, as in the prior art, for gate plates to maintain the separation between the trip and latch elements.

In order to reset the device, it is first necessary for the user to displace the actuator 62 from the position shown in FIG. 6 to the position shown in FIG. 3. Two actions simultaneously occur during this displacement. The switch 40 is opened, and the circuit breaker 42 is reset to the latched closed position. Since the arms 44 are directly mounted on the actuator 62, they are jointly displaced with the actuator to a non-contacting position relative to the load terminal 34. Since the trip element 48 is also mounted on the actuator 62 and, in effect, at this time, engages the lower edges of the actuator 62,.the trip element 48 is affirmatively displaced with and by the actuator 62 until latching engagement is again obtained between the tongue 52 and the opening 50. Prior to this, the breaker contacts 54, 60 electromechanically engage each other. Even though the circuit breaker has been reset, electrical current still cannot flow to the load since the switch 40 is open. Thus, the device can never be reset under load, thereby protecting the load in the event that the overload condition persists, and also protecting the breaker contacts 54, 60 from coming together under possibly a large overload.

As the second and final step in the reset procedure, the user displaces the actuator 62 back to its closed position as shown in FIG. 2. The switch 40 is thereby closed since the arms 44 are displaced with and by the actuator 62. The bimetallic latch element 46 remains latched to the trip element 48. The breaker contacts 54, 60 remain in contact with each other. Since both the switch 40 and the circuit bareaker 42 are closed and circuit breaker 42 are closed and in series with each other, the normal operating condition for the device is now resumed, provided, of course, that the overload condition no longer exists.

The use of three parallel connected arms 44 is particularly advantageous because they are self-aligning and automatically wear evenly during use. Ideally, the linear edge regions should be co-linear. If, however, due to tolerance variations, material variations, or for whatever reason, one of the arms, for example, should make wiping contact with the terminal 34 at a later time than the other two arms, then the other two arms will wear, due to electrical arcing thereat, more than said one arm until the other two arms are worn or eroded to the same extent as said one arm. The curved arms 44 quickly make wiping contact with the terminal 34, and more slowly break such wiping contact.

The use of breaker contacts 54, 60 at a remote location spaced from the contact regions at which the tongue 52 and the opening 50 latchingly engage each other is especially advantageous, because the contact regions at the tongue 52 and opening 50 are not directly exposed to the wearing action caused by arcing when the device is actuated from the tripped condition of FIG. 6 to the reset condition of FIG. 3 during the reset procedure. It will be observed that the breaker contacts 54, 60 mutually engage each other before the contact regions at the tongue 52 and the opening 50 engage each other, and separate after tongue 52 and opening 50 separate during an overload. Hence, the contact regions at the tongue 52 and opening 50 do not experience arcing since arcing, if any, will occur at the last parts to separate. Thus, the latching action between the latch and trip elements 46, 48 does not deteriorate over time due to arcing, and the bimetallic element 46 does not go out of calibration.

It will be understood that each of the elements described above, or two or more together, may also find a useful application in other types of constructions differing from the type described above.

While the invention has been illustrated and described as embodied in an improved switch and circuit breaker combination device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A device for protecting an electrical load from electrical current overload, comprising:

(a) a housing;

(b) electrical switching means on the housing and including an actuatable switch element movable between open and closed positions to respectively prevent and enable electrical current to flow through the switching means;

(c) resettable circuit breaker means in the housing for interrupting current flow to the load in response to a current overload, and for preventing resumption of the current flow until the breaker means is reset, said breaker means being electrically connected in series with the switching means and including a latch element and a resettable trip element, said latch element being movable along a path in response to the current overload from a latched position to a tripped position in which the latch and trip elements are respectively latched and unlatched relative to each other;

(d) actuator means for resetting the trip element from the tripped to the latched position, and for simultaneously moving the switch element from the closed to the open position to prevent current from flowing to the load during resetting, said actuator means being further operative for moving the switch element from the open to the closed position while maintaining the trip element in the latched position to enable current to resume flowing to the load after resetting, said actuator means including an actuator mounted on the housing for manual displacement;

(e) means for mounting the switch element on the actuator for joint displacement therewith; and (f) means for mounting the trip element on the actuator for joint displacement therewith during resetting, said trip element being biasingly urged for displacement relative to the actuator away from said path to the tripped position and maintained at a distance from and out of engagement with, the latch element until the breaker means is reset.

2. The device according to claim 1, wherein the switching means includes a stationary contact, and wherein the switch element includes a plurality of movable contacts in wiping contact with the stationary contact in the closed position and having self-aligning, evenly-wearing contact regions.

3. The device according to claim 2, wherein the movable contacts are constituted of a copper alloy, and wherein the switching means includes three movable contacts having curved shapes, said curved contacts terminating in linear edge regions that are mutually co-linear.

4. The device according to claim 1, wherein the latch element is a bimetallic element that bends a predetermined distance when electrical current passing therethrough exceeds a predetermined value.

5. The device according to claim 4, wherein the bimetallic element has an opening, and wherein the trip element has a trip finger receivable with latchtype action in the opening.

6. The device according to claim 1, wherein the switch element and the trip element are of one-piece construction, and are formed of a copper alloy plate.

7. The device according to claim 6, wherein the mounting means for the switch and trip elements includes fastener means for fastening the one-piece plate to the actuator.

8. The device according to claim 1, wherein the circuit breaker means includes indicator means for visually indicating the occurrence of a circuit breaker position.

9. The device according to claim 8, wherein the indicator means includes a lamp that is lit only upon the occurrence of the closed switch position.

10. The device according to claim 8, wherein the indicator means includes a flag on the trip element, and wherein the flag is visible through the actuator in the tripped position.

11. The device according to claim 10, wherein the actuator has a transparent window through which the flag is viewable.

12. The device according to claim 1, wherein the breaker means includes a pair of breaker contacts through which current flows through the breaker means, and wherein the latch and trip elements engage each other at contact regions in the latched position, and wherein the breaker contacts are spaced from the contact regions and separate after the contact regions separate during movement of the breaker means from the latched to the tripped position.

13. The device according to claim 1; and further comprising a pair of snap-action legs on the housing and operative for mounting the housing in a panel cutout with a snap-type action.

14. The device according to claim 1, wherein the actuator is mounted for reciprocal movement about a pivot axis on the housing, and wherein the trip element is urged to the tripped position in a circumferential path about a point displaced from the pivot axis.

15. An electrical switch, comprising:

(a) a housing;

(b) an actuator mounted on the housing for displacement therewith;

(c) a stationary electrically conductive contact mounted on the housing; and (d) an actuatable switch element movable by the actuator between open and closed positions to respectively prevent and enable electrical current to flow through the switch, said switch element including a plurality of movable arms extending along respective arcs and terminating in linear edge contact regions that wipingly engage the stationary contact in the closed position, said arms being constituted of an electrically conductive, erodable material that wears due to electrical arcing at the linear edge contact regions when the element is moved to the open position, thereby aligning the linear edge contact regions, said aligned and worn linear edge contact regions being mutually co-linear.

* * * * *